US006713973B2

(12) United States Patent
Erhardt

(10) Patent No.: US 6,713,973 B2
(45) Date of Patent: Mar. 30, 2004

(54) SYSTEM AND METHOD OF AUTOMATIC CYCLING CONTROL FOR HID LAMPS

(75) Inventor: Robert Alexander Erhardt, Schaumburg, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/413,125

(22) Filed: Apr. 14, 2003

(65) Prior Publication Data

US 2003/0210000 A1 Nov. 13, 2003

Related U.S. Application Data

(62) Division of application No. 09/867,350, filed on May 29, 2001, now Pat. No. 6,583,588.

(51) Int. Cl.[7] ..... H05B 41/36
(52) U.S. Cl. ..... 315/291; 315/360
(58) Field of Search ..... 315/291, 360, 315/363; 307/140, 141, 142, 139

(56) References Cited

U.S. PATENT DOCUMENTS 4,349,748 A * 9/1982 Goldstein et al. ..... 307/132 E
5,287,039 A * 2/1994 Gregor et al. ..... 315/248
5,723,951 A * 3/1998 Byszewski et al. ..... 315/174
6,011,329 A * 1/2000 McGovern ..... 307/141.4

* cited by examiner

*Primary Examiner*—Don Wong
*Assistant Examiner*—Thuy Vinh Tran

(57) ABSTRACT

The present invention provides a system and method of automatic cycling control for HID lamps, comprising a device for switching power to the HID lamp, a first timer operatively connected to the power switching device, and a second timer operatively connected to the power switching device, wherein the first timer starts timing when the power switching device powers the HID lamp and signals the power switching device to extinguish the HID lamp when the first timer counts to an operating time setpoint, and the second timer starts timing when the power switching device extinguishes the HID lamp and signals the power switching device to power the HID lamp when the second timer counts to a cooling time setpoint. If the lamp is turned off and on before the operating time setpoint is met, the system will reset and begin a new operating timing period.

11 Claims, 4 Drawing Sheets

SYSTEM AND METHOD OF AUTOMATIC CYCLING CONTROL FOR HID LAMPS

This is a division of application Ser. No. 09/867,350 filed May 29, 2001, now U.S. Pat. No. 6,583,588.

TECHNICAL FIELD

The technical field of this disclosure is lighting control, particularly, control of automatic cycling for HID lamps.

BACKGROUND OF THE INVENTION

High Intensity Discharge (HID) lamps, such as mercury vapor, metal halide, high-pressure sodium and low-pressure sodium light sources, are used for a variety of lighting tasks. It is known that many HID lamps need to be turned off at least once per week to maintain proper operation. This requirement is listed on the specifications for many lamps, in particular, for metal halide lamps. HID lamp manufacturers instruct users to cycle HID lamps off and on every 168 hours or so (about once per week).

Many applications involve operation of HID lamps for long times without turning them off, however. It is up to the end user of the lamp to turn off the HID lamps at least once per week, either manually or through an automatic building control system external to the lighting fixture. Through either ignorance or negligence, this requirement may not always be met. In some applications, it may not be possible or desirable to turn off all the lights in a given area at once. This can result in improper operation of the lighting system and the lamps may be left on continuously.

If lamps are not turned off regularly, they may fail catastrophically with rupture of the arc tube. The rupture can damage the lighting fixture and its surroundings, and may even pose a hazard to personnel if the lamp is operated in an unprotected fixture.

It would be desirable to have an automatic cycling control for HID lamps that would overcome the above disadvantages.

SUMMARY OF THE INVENTION

One aspect of the present invention provides automatic cycling control for HID lamps.

Another aspect of the present invention provides automatic cycling control for HID lamps integral to the HID lamp system.

Another aspect of the present invention provides automatic cycling control for HID lamps with varied timing to stagger cycling in groups of HID lamps.

Another aspect of the present invention provides automatic cycling control for HID lamps that avoids unnecessary cycling if cycling has already occurred.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DESCRIPTION OF THE PREFERRED EMBODIMENT

The automatic cycling control for HID lamps of the present invention serves the purpose of insuring that lamps are cycled at least once per week by having a "default" operating time within the ballast operating the lamp. If the HID lamp system has not been cycled off before the default operating time has been reached, the ballast will automatically turn the lamp off and turn it back on again insuring that the lamps continue to operate as designed. If the lamp is turned off and on before the default operating time is met, the ballast will reset itself and begin a new default operating timing period.

Figure 1:
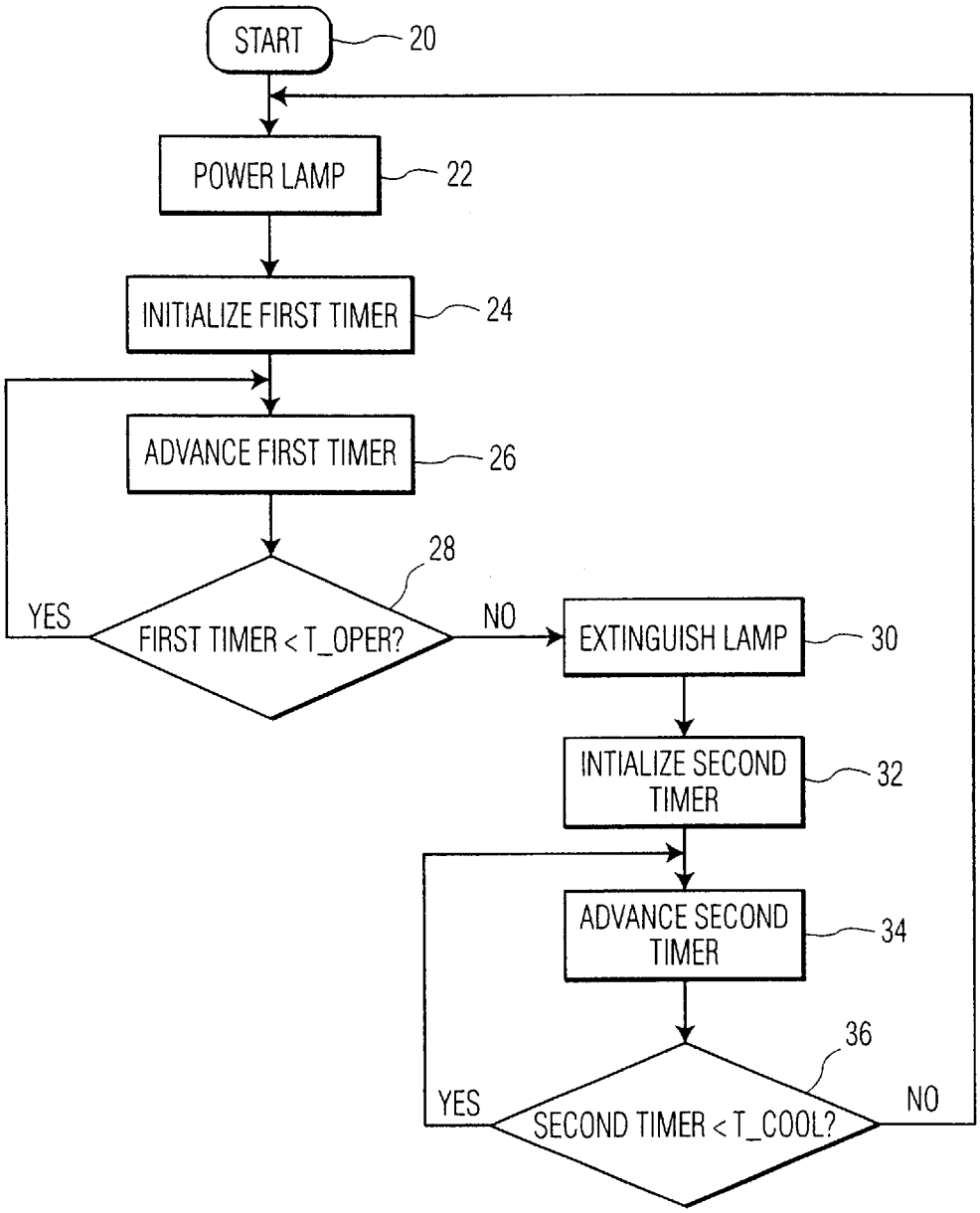
FIG. 1 shows a flow chart of automatic cycling control for HID lamps made in accordance with the present invention.

FIG. 1 shows a flow chart of automatic cycling control for HID lamps. The automatic cycling control starts a block 20 when the HID lamp is switched on. If the HID lamp is shut off at anytime while the automatic cycling control is active, the automatic cycling control will restart from block 20 since the HID lamp will have been cycled off in accordance with manufacturer's instructions. Power is applied to the HID lamp at block 22 and the first timer is initialized at block 24. The automatic cycling control then enters the operation timing loop.

The first timer is advanced at block 26. Where a number of HID lamps are installed in a given location, the timing clock rate (the timer counting rate relative to actual time) can intentionally be varied between lamps, so that not all fixtures switch off simultaneously. This can be accomplished by using a "clock" that is modeled on an "analog" oscillator using a resistor and capacitor each with some tolerance. With a 5% tolerance on the clock, the ballasts can be made to switch randomly over an eight hour period the first time the ballasts switch off and over an even greater range on subsequent cycles. The tolerance can be selected as any value desired for a particular application and can vary widely, depending on the particular application. Typical values would be between one half percent and one hundred percent.

The first timer is compared to the operating time setpoint ($T_{13}$ Oper) at block 28. The operating time setpoint is the time recommended by the HID lamp manufacturer after which the HID lamp should be cycled off to maintain proper operation. The operating time setpoint can be selected as any value desired for a particular application and can vary widely, depending on the particular application. Typical operating time setpoints can be between 12 hours and 336 hours, and, more typically, about one week or about 168 hours. Other operating time setpoints are possible for different HID lamp designs and operating conditions. The operating time setpoint may also be selected depending on the environment where the HID lamp is used. In a large warehouse with numerous HID lamps, individual HID lamps can be cycled more frequently than if only a single HID lamp is illuminating an area, because the energized HID lamps will provide continuous illumination.

Where a number of HID lamps are installed in a given location, the operating time setpoints can intentionally be varied between ballasts, so that not all fixtures switch off simultaneously. The ballasts can be programmed with different operating time setpoints during production to further insure a random distribution of cycling. If different operating time setpoints are programmed into different ballasts, a more accurate first timer can he used in connection with block 26 above. In an alternate embodiment, an individual ballast can generate a random operating time setpoint when the HID lamp is energized. The operating time setpoint can be random within a predetermined range of possible times. This provides random cycling in a group of lamps, without the need to program the randomness during production.

If the first timer is less than the operating time setpoint (T_Oper) at block 28, the automatic cycling control returns to block 26 and the timing continues. If the first timer is equal or greater than the operating time setpoint (T_Oper) at block 28, the automatic cycling control extinguishes the HID lamp at block 30. The second timer is initialized at block 32 and the automatic cycling control enters the cooling time loop.

The second timer is advanced at block 34 and the second timer is compared to the cooling time setpoint (T_Cool) at block 36. The cooling time setpoint can be as short as a few milliseconds, as long as several minutes, or even a number of hours. In the case of a cooling time setpoint of a few milliseconds, the lamp will remain extinguished until it cools enough for a "restrike" to take place. The cooling time must be long enough to avoid an instantaneous restrike and the lower limit will vary with HID lamp design. It is also possible to set the cooling time setpoint to a longer period to allow for a complete cool down of the lamp. The upper limit is determined by the time the lights may be off for a particular customer in a particular application. The operating time cooling time setpoint may also be selected depending on the environment where the HID lamp is used. In a large warehouse with numerous HID lamps, individual HID lamps can be cooled for a longer period than if only a single HID lamp is illuminating an area, because the energized HID lamps will provide continuous illumination. Many lamps require a cool down period of at least 15 minutes to insure proper operation. Typical cooling time setpoints can be between 5 milliseconds and 2 hours and, more typically, about 15 minutes to 30 minutes.

If the second timer is less than the cooling time setpoint (T_Cool) at block 36, the automatic cycling control returns to block 34 and the timing continues. If the second timer is equal or greater than the cooling time setpoint (T_Cool) at block 36, the automatic cycling control re-powers the HID lamp at block 22 and the automatic cycling control begins again.

The references to timers herein are intended as examples only and those skilled in the art will immediately appreciate that many devices and methods for counting, measuring and comparing time and time periods in accordance with the present invention are possible, and that such embodiments are contemplated and fall within the scope of the presently claimed invention. Such devices include, but are not limited to, electronic counters, electronic timers, timer circuits formed from discrete components, solid state timers, solid state timers embedded within microprocessors, and mechanical timers.

Figure 2:
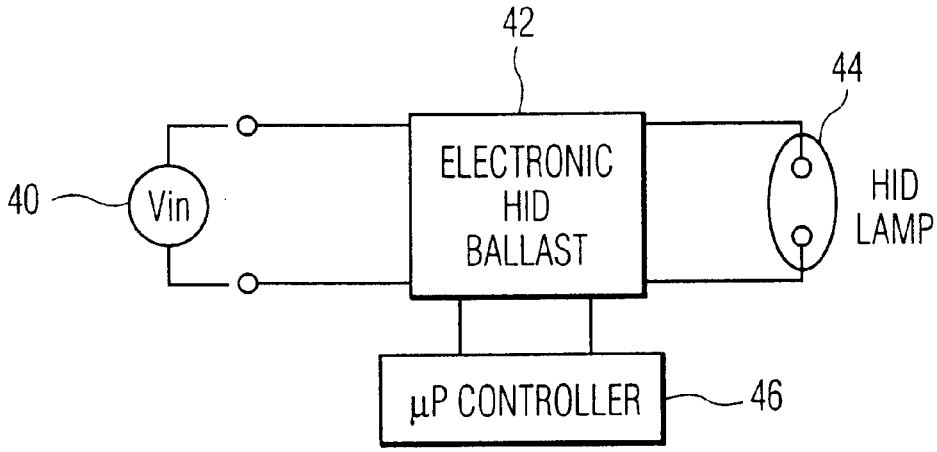
FIG. 2 shows a schematic diagram of an HID lamp system using an electronic HID ballast made in accordance with the present invention.

The automatic cycling control of FIG. 1 can be applied to HID lamps using an electronic or electromagnetic ballast. FIG. 2 shows a schematic diagram of an HID lamp system using an electronic HID ballast and FIG. 3 shows a schematic diagram of an HID lamp system using an electromagnetic ballast.

In FIG. 2, which shows a schematic diagram of an HID lamp system using an electronic HID ballast, an input voltage 40 is applied to electronic HID ballast 42, which is electrically connected to HID lamp 44. Microprocessor 46 is electrically connected to and controls the electronic HID ballast 42. The microprocessor 46 has the ability to carry out program steps as required to perform the automatic cycling control as described in FIG. 1 and the ability to control the supply of power to the lamp. The microprocessor 46 can have other functions within the electronic HID ballast 42 as desired. The microprocessor 46 can be internal or external to the electronic HID ballast 42. Microprocessor 46 can have ROM, RAM, or other computer readable storage media for storing program code to carry out the automatic cycling control as described in FIG. 1.

Figure 3:
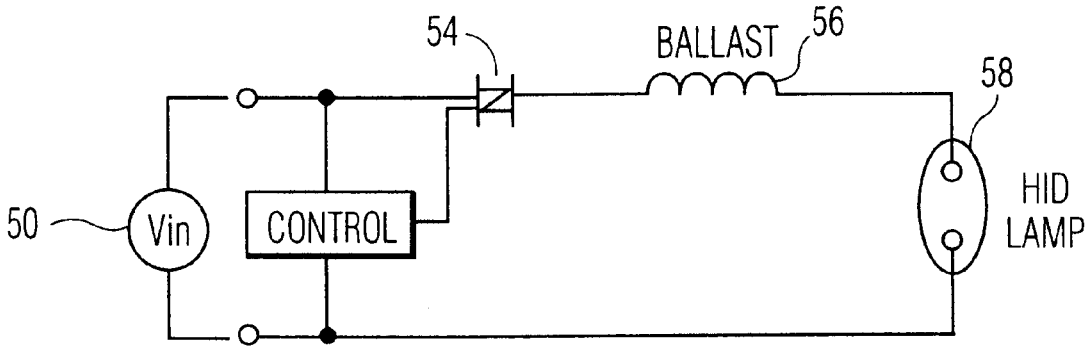
FIG. 3 shows a schematic diagram of an HID lamp system using an electromagnetic ballast made in accordance with the present invention.

In FIG. 3, which shows a schematic diagram of an HID lamp system using an electromagnetic ballast, an input voltage 50 is applied across control circuit 52. The input voltage 50 is also applied across switching device 54, electromagnetic ballast 56, and HID lamp 58, which are connected in series so that the switching device 54 can control current flow through the series. The control circuit 52 controls the switching device 54. The switching device 54 can be a triac, relay, or other switching device, depending on the particular application. Although FIG. 3 shows use of an electromagnetic ballast, this configuration can also be used with electronic ballasts.

Figure 4:
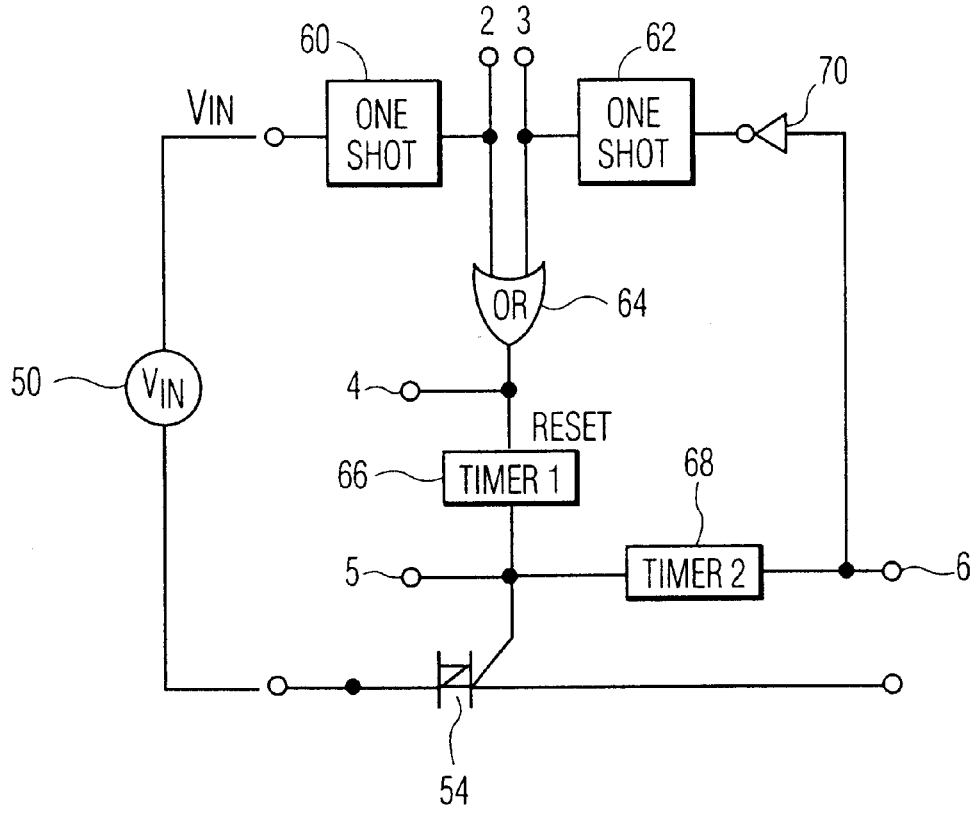
FIG. 4 is a schematic diagram providing detail of the control circuit of FIG. 3.
Figure 5:
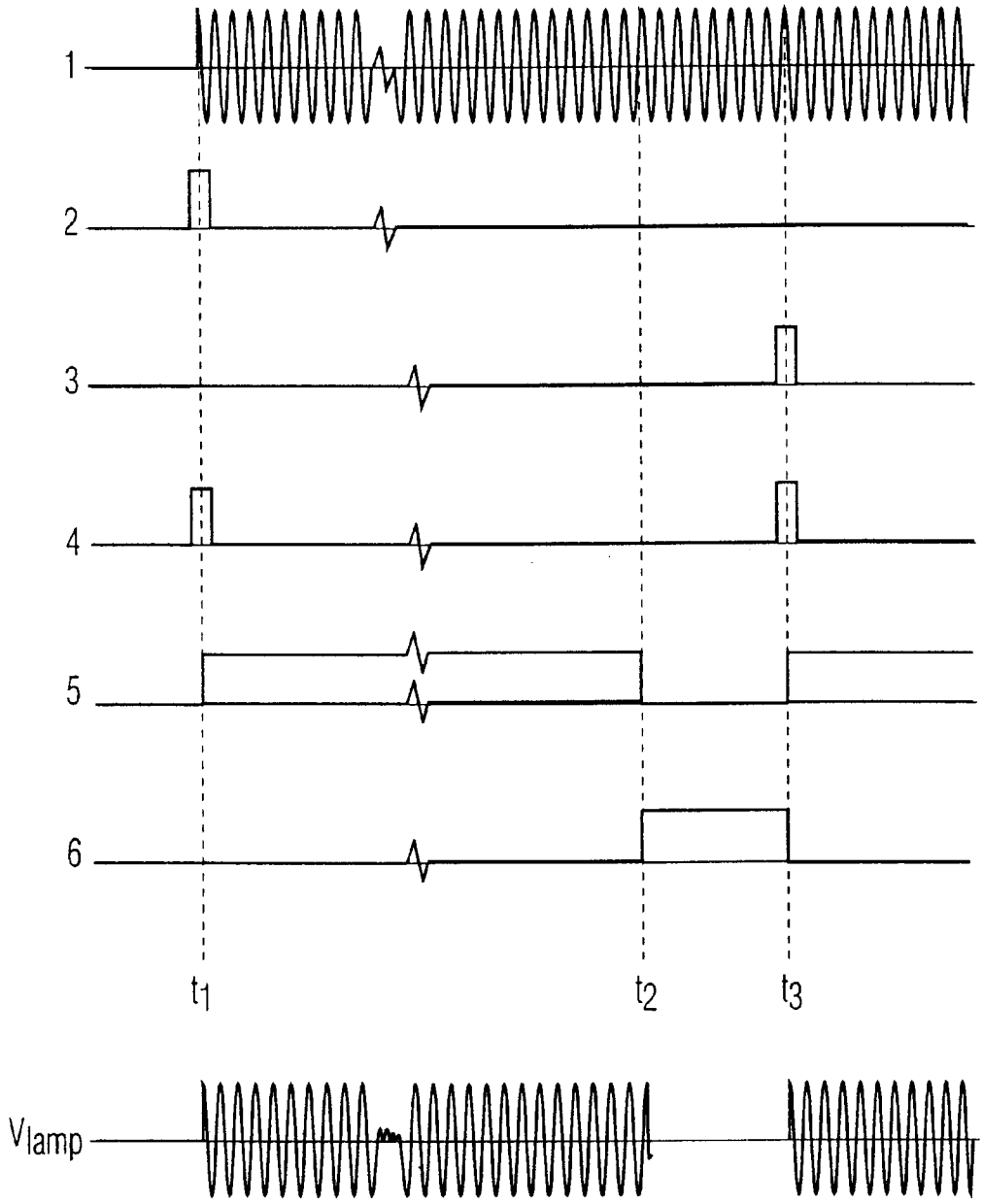
FIG. 5 shows a timing diagram for some of the waveforms for the control circuit of FIG. 4.

FIG. 4, wherein like elements have like reference numbers with FIG. 3, is a schematic diagram providing detail of the control circuit 52 of FIG. 3. FIG. 5 shows a timing diagram for some of the waveforms for the control circuit 52 of FIG. 4.

Referring to FIG. 4, voltage 50 appears at the input to first one shot 60 when power is applied to the HID lamp system. This produces a momentary pulse at the output of the first one shot 60 that is ORed with the output of second one shot 62 at OR gate 64 to produce a pulse at the reset input of first timer 66. This produces a high signal at the output of first timer 66 that turns on the switching device 54 and voltage is applied to the HID lamp. First timer 66 is configured in monostable mode to give a high signal at its output for a period of the operating time setpoint recommended by the manufacturer, typically about 168 hours. This operating time setpoint can have a tolerance associated with it so that not all HID lamps switch off simultaneously when a group of HID lamps is used in a given area. When first timer 66 reaches the operating time setpoint, its output goes low, the switching device 54 switches off, and voltage is removed from the HID lamp. Second timer 68 is configured in monostable mode to begin a timing period at the negative edge of the output of first timer 66. Second timer 68 times for a time period equal to the cooling time setpoint, typically in excess of 15 minutes. At the end of the cooling time, the negative edge of the output of second timer 68 produces a pulse through inverter 70 via the second one shot 62 to reset first timer 66 and the sequence begins again. Multiple circuit configurations can accomplish the same function and many other equivalent circuits will be readily apparent to those skilled in the art. Although FIG. 4 shows use of the circuit with an electromagnetic ballast, this circuit can also be used with electronic ballasts by using the control circuitry of the electronic ballast to interrupt power to the lamp and omitting the switching device 54.

FIG. 5 shows a timing diagram for some of the waveforms for the control circuit 52 of FIG. 4. Diagram 1 shows the input to first one shot 60. Diagrams 2 and 3 show the inputs to OR gate 64. Diagram 4 shows the input to first timer 66 and Diagram 5 shows the input to second timer 68. Diagram 6 shows the output of the second timer 68. Diagram 6 shows the trace with a positive polarity: the trace would be inverted in another embodiment if the circuit were designed omitting the inverter 70. The $V_{lamp}$ trace shows the input to the HID lamp 58. Power is applied to the control circuit at time $t_1$. The HID lamp is on for the operating time from $t_1$ to $t_2$. The lamp is cycled off at $t_2$ and remains off for the cooling time from $t_2$ to $t_3$. At $t_3$, the cycle starts again.

It is important to note that FIGS. 2–5 illustrate specific applications and embodiments of the present invention, and are not intended the limit the scope of the present disclosure or claims to that which is presented therein. Upon reading the specification and reviewing the drawings hereof, it will become immediately obvious to those skilled in the art that myriad other embodiments of the present invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A computer readable medium storing a computer program for automatic cycling control for HID lamps, the computer program comprising:

computer readable code for providing power to the HID lamp;

computer readable code for initializing a first timer;

computer readable code for advancing the first timer;

computer readable code for comparing the first timer to an operating time setpoint;

computer readable code for advancing the first timer if the first timer is less than the operating time setpoint;

computer readable code for removing power from the HID lamp and initializing a second timer if the first timer is equal to or greater than the operating time setpoint;

computer readable code for advancing the second timer;

computer readable code for comparing the second timer to a cooling time setpoint;

computer readable code for advancing the second timer if the second timer is less than the cooling time setpoint; and computer readable code for providing power to the HID lamp if the second timer is equal to or greater than the cooling time setpoint.

2. The computer readable medium of claim 1 wherein the operating time setpoint is a value recommended by a HID lamp manufacturer.

3. The computer readable medium of claim 1 wherein the operating time setpoint is between 12 hours and 336 hours.

4. The computer readable medium of claim 3 wherein the operating time setpoint is about a week.

5. The computer readable medium of claim 1 wherein the operating time setpoint for an individual HID lamp is selected according to a distribution such that the operating time setpoints vary for a group of HID lamps.

6. The computer readable medium of claim 1 wherein the operating time setpoint for the HID lamp is selected randomly, the operating time setpoint being selected within a predetermined range.

7. The computer readable medium of claim 1 wherein a clock rate of the first timer for an individual HID lamp is selected according to a distribution such that the clock rates vary for a group of HID lamps.

8. The computer readable medium of claim 7 wherein the distribution of the clock rates is in a range between one half percent to 100 percent tolerance.

9. The computer readable medium of claim 7 wherein the distribution of the clock rates is outside a 5 percent tolerance.

10. The computer readable medium of claim 1 wherein the cooling time setpoint is between 5 milliseconds and 2 hours.

11. The computer readable medium of claim 10 wherein the cooling time setpoint is about 15 minutes.

* * * * *